US011701902B2

(12) United States Patent
Yamaguchi

(10) Patent No.: US 11,701,902 B2
(45) Date of Patent: Jul. 18, 2023

(54) IMAGE FORMING APPARATUS

(71) Applicant: Brother Kogyo Kabushiki Kaisha, Nagoya (JP)

(72) Inventor: Masatomo Yamaguchi, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 8 days.

(21) Appl. No.: 17/533,429

(22) Filed: Nov. 23, 2021

(65) Prior Publication Data

US 2022/0169051 A1 Jun. 2, 2022

(30) Foreign Application Priority Data

Nov. 27, 2020 (JP) ..... 2020-196866
Nov. 27, 2020 (JP) ..... 2020-197061

(51) Int. Cl.
*B41J 15/04* (2006.01)
*B41J 11/70* (2006.01)
*G03G 15/00* (2006.01)
*B26D 1/04* (2006.01)

(52) U.S. Cl.
CPC ..... *B41J 11/70* (2013.01); *B41J 15/042* (2013.01); *G03G 15/6517* (2013.01); *G03G 15/6523* (2013.01); *B26D 1/045* (2013.01)

(58) Field of Classification Search
CPC ..... B41J 11/70; B41J 15/042; B26D 1/045; G03G 15/6517; G03G 15/6523
See application file for complete search history.

(56) References Cited

FOREIGN PATENT DOCUMENTS

| | | | | | |
|---|---|---|---|---|---|
| JP | H02264556 | A | * | 10/1990 | ..... H04N 1/00 |
| JP | 2003-260830 | A | | 9/2003 | |
| JP | 2006-327113 | A | | 12/2006 | |
| JP | 2010069770 | A | * | 4/2010 | ..... B41J 2/175 |
| JP | 2013-086235 | A | | 5/2013 | |
| JP | 2014-166705 | A | | 9/2014 | |
| JP | 2020111449 | A | * | 7/2020 | ..... B65H 29/60 |

* cited by examiner

*Primary Examiner* — Yaovi M Ameh
(74) *Attorney, Agent, or Firm* — Banner & Witcoff, Ltd.

(57) ABSTRACT

An image forming apparatus, having a housing, a tray detachably attachable to the housing and having a storage to store a sheet-formed medium, an image forming device to form an image on the sheet-formed medium, a conveyer assembly to convey the sheet-formed medium from the storage along a conveyer path, and a cutter to cut the sheet-formed medium at a predetermined position in the conveyer path, is provided. The conveyer assembly includes a feeder roller to feed the sheet-formed medium from the storage to the conveyer path, and an intermediate roller pair arranged in the conveyer path between the feeder roller and the image forming device. The intermediate roller pair is supported by the housing and is configured to nip the sheet-formed medium. The predetermined position is located in the conveyer path between the feeder roller and the intermediate roller pair.

12 Claims, 5 Drawing Sheets

IMAGE FORMING APPARATUS

CROSS REFERENCE TO RELATED APPLICATIONS

This application claims priority under 35 U.S.C. § 119 from Japanese Patent Applications No. 2020-197061 and No. 2020-196866, both filed on Nov. 27, 2020, the entire subject matters of which are incorporated herein by reference.

BACKGROUND

The present disclosure is related to an image forming apparatus having a cutter for cutting a sheet-formed medium.

An image forming apparatus, which is capable of forming an image on a sheet-formed medium while the sheet-formed medium is being conveyed in a conveying direction along a conveyer path, is known. The sheet-formed medium may be, for example, a sheet, a piece, or a strip of paper, cloth, and labels and may be wound to a roll. The image forming apparatus may be equipped with a cutter for cutting the sheet-formed medium. More specifically, the image forming apparatus may have a rolled-sheet storage to store the rolled sheet of imaging medium, an image forming device, a sheet conveyer for conveying the sheet-formed medium unwound from the rolled-sheet storage along the conveyer path, and a cutter for cutting the sheet-formed medium at a position downstream from the image forming device in the conveyer path. Moreover, the sheet conveyer may have a feeder roller pair, which may feed the sheet-formed medium from the rolled-sheet storage to the conveyer path, and an intermediate roller pair including a registration roller and a registration pressure roller, which may be located at a position upstream from the image forming device in the conveyer path.

SUMMARY

For example, the rolled-sheet storage may be arranged in a tray, which may be removably attached to a body of the image forming apparatus. Meanwhile, the cutter may be located at a position downstream from the intermediate roller pair, i.e., the registration roller and the registration pressure roller. In this arrangement, after the sheet-formed medium is cut by the cutter, a part of the sheet-formed medium having a loose end and remaining in the image forming apparatus and located upstream from the cutter in the conveying direction may remain nipped by the registration roller and the registration pressure roller. With the part of the sheet-formed medium being nipped by the registration roller and the registration pressure roller, when the tray is removing from the body, a removing load to remove the tray may act on the sheet-formed medium, and the sheet-formed medium may be deformed or damaged.

Meanwhile, in order to prevent the sheet-formed medium from being deformed or damaged, the part of the sheet-formed medium with the loose end may be rewound into the roll in the rolled-sheet storage. In this arrangement, however, with the cutter located at the position downstream from the image forming device in the conveyer path, the part of the sheet-formed medium being rewound may travel a distance from the position of the cutter and the rolled-sheet storage, and the rewinding action may take time.

The present disclosure is advantageous in that an image forming apparatus, in which a sheet-formed medium may be restrained from being subject to a load caused when a tray having a rolled-sheet storage is removed from a body, is provided. Moreover, the present disclosure is advantageous in that an image forming apparatus, in which an amount of the sheet-formed medium to be rewound may be reduced, and a time required for the rewinding action may be shortened, is provided.

According to an aspect of the present disclosure, an image forming apparatus, having a housing, a tray, an image forming device, a conveyer assembly, and a cutter, is provided. The tray is detachably attachable to the housing and has a storage configured to store a sheet-formed medium. The image forming device is configured to form an image on the sheet-formed medium. The conveyer assembly is configured to convey the sheet-formed medium from the storage along a conveyer path. The cutter is configured to cut the sheet-formed medium at a predetermined position in the conveyer path. The conveyer assembly includes a feeder roller configured to feed the sheet-formed medium from the storage to the conveyer path, and an intermediate roller pair arranged in the conveyer path between the feeder roller and the image forming device. The intermediate roller pair is supported by the housing and is configured to nip the sheet-formed medium. The predetermined position is located in the conveyer path between the feeder roller and the intermediate roller pair.

According to another aspect of the present disclosure, an image forming apparatus, having a storage, an image forming device, a conveyer assembly, and a cutter, is provided. The storage is configured to store a sheet-formed medium. The image forming device is configured to form an image on the sheet-formed medium. The conveyer assembly is configured to convey the sheet-formed medium from the storage in a conveying direction along a conveyer path. The cutter is configured to cut the sheet-formed medium at a predetermined position in the conveyer path. The storage is configured to store a rolled body, which is the sheet-formed medium wound into a roll. The conveyer assembly includes a feeder roller configured to feed the sheet-formed medium from the storage to the conveyer path, an intermediate roller arranged in the conveyer path between the feeder roller and the image forming device, and a conveyer roller arranged in the conveyer path between the intermediate roller and the image forming device. The predetermined position is located in the conveyer path between the feeder roller and the intermediate roller.

DETAILED DESCRIPTION

Figure 1:
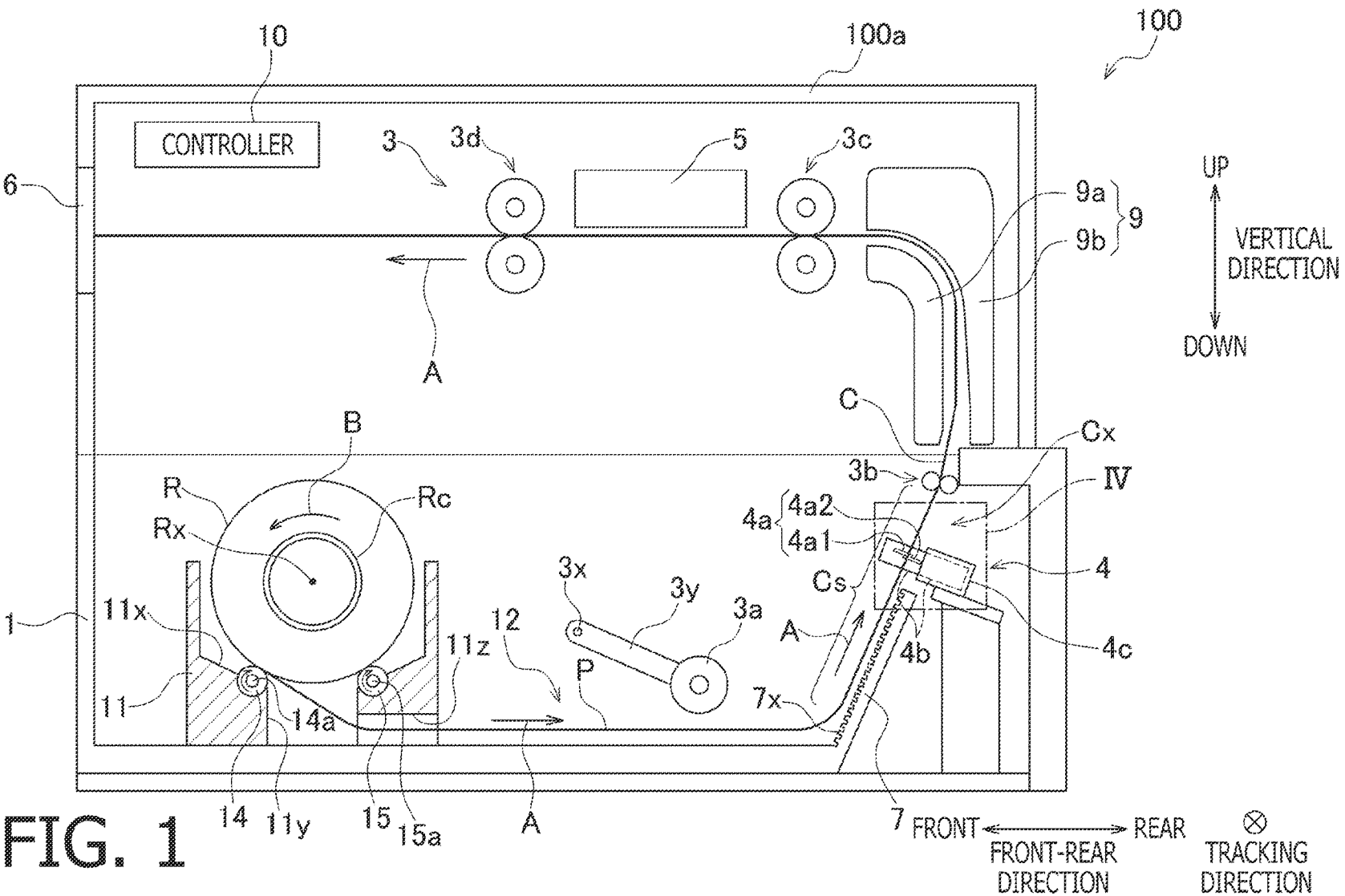
FIG. 1 is an overall illustrative view of a printer according to a first embodiment of the present disclosure.

In the following paragraphs, with reference to the accompanying drawings, embodiments of the present disclosure will be described. It is noted that various connections may be set forth between elements in the following description. These connections in general and, unless specified otherwise, may be direct or indirect and that this specification is not intended to be limiting in this respect.

First Embodiment

<Overall Configuration of Printer>

In the following paragraphs, with reference to FIGS. 1 and 2, an overall configuration of a printer 100 according to the first embodiment of the present disclosure will be described. In the following description, positional relation within the printer 100 and each part or item included in the printer 100 will be referred to on basis of an orientation of the printer 100 as indicated by the bi-directionally pointing arrows in FIG. 1. In other words, a vertical direction and a front-rear direction indicated in FIGS. 1-2 will be defined as a vertical direction and a front-rear direction of the printer 100.

The printer 100 includes a housing 100*a*, a feeder tray 1, a conveyer assembly 3, a cutter assembly 4, a head 5, an ejection tray 6, and a controller 10. The feeder tray 1 may have a shape of a top-open box and may be detachably attached to a lower part of the housing 100*a*. The feeder tray 1 may be moved with respect to the housing 100*a* from the rear side toward the front side to be removed from the housing 100*a* and may be moved from the front side toward the rear side to be attached to the housing 100*a*. The ejection tray 6 is formed of a side wall being an upper-frontward part of the housing 100*a* and is openable or closable with respect to the housing 100*a*.

The feeder tray 1 includes a rolled-sheet storage 11, in which a rolled sheet R (see FIG. 1) may be stored, and a cut-sheet storage 12, in which a cut sheet Pc (see FIG. 2) may be stored.

The rolled sheet R (see FIG. 1) is an elongated strip of sheet P rolled around an outer circumferential surface of a core member Rc in a cylindrical shape. The rolled sheet R may be stored in the rolled-sheet storage 11 in an arrangement such that a rotation axis Rx thereof, i.e., a central axis of the core member Rc, aligns with a direction orthogonal to the vertical direction and the front-rear direction. The direction orthogonal to the vertical direction and the front-rear direction may be a direction of a width of the sheet P and hereinafter called as a tracking direction.

The rolled-sheet storage 11 has a recess 11X, in which the rolled sheet R may be stored. In a bottom area of the recess 11X, two (2) rolled-sheet feeder rollers 14, 15, which form a part of the conveyer assembly 3, are arranged. The rolled-sheet feeder rollers 14, 15 may rotate about axes 14*a*, 15*a*, respectively, which extend in the tracking direction. The rolled sheet R may be, when being stored in the recess 11*x*, supported by the rolled-sheet feeder rollers 14, 15 at a lower circumferential surface thereof.

The rolled-sheet storage 11 further has a hole 11*y*, which is continuous with the recess 11*x* and extends in the vertical direction, and a passage 11*z*, which is continuous with the hole 11*y* and extends in the front-rear direction. A bottom surface of the rolled-sheet storage 11 forms bottom surfaces of the hole 11*y* and the passage 11*z*. The sheet P unrolled from the rolled sheet R may be conveyed through the hole 11*y* and the passage 11*z* toward the head 5.

The cut sheet Pc (see FIG. 2) may include one or more sheets P, each of which has a length in a conveying direction A shorter than a length of the sheet P in the rolled sheet R and longer than a distance between a cut-sheet feeder roller 3*a* (described below) and an intermediate roller pair 3*b* (described below) in a conveyer path C. The cut-sheet storage 12 is in a rearward area in the feeder tray 1 with respect to the rolled-sheet storage 11 and may accommodate the cut sheets Pc stacked in the vertical direction.

When the rolled sheet R is used in the printer 100, the cut sheets Pc may be removed from the cut-sheet storage 12 (see FIG. 1). In contrast, when the cut sheet Pc is used in the printer 100, the rolled sheet R may be removed from the rolled-sheet storage 11 (see FIG. 2).

The conveyer assembly 3 may convey the sheet P selectively from one of the rolled-sheet storage 11 and the cut-sheet storage 12. The conveyer assembly 3 includes the rolled-sheet feeder rollers 14, 15, the cut-sheet feeder roller 3*a*, the intermediate roller pair 3*b*, a conveyer roller pair 3*c*, an ejection roller pair 3*d*, and guides 7, 9. The sheet P from one of the rolled-sheet storage 11 and the cut-sheet storage 12 may be conveyed by the conveyer assembly 3 along the conveyer path C in the conveying direction A through an area below the head 5 toward the ejection tray 6.

The rolled-sheet feeder rollers 14, 15 are arranged in the bottom area of the rolled-sheet storage 11. The cut-sheet feeder roller 3*a* is arranged in the conveyer path C at a position above the cut-sheet storage 12 between the rolled-sheet storage 11 and the head 5. The intermediate roller pair 3*b* is arranged in the conveyer path C between the cut-sheet feeder roller 3*a* and the head 5. The conveyer roller pair 3*c* is arranged in the conveyer path C between the intermediate roller pair 3*b* and the head 5. The ejection roller pair 3*d* is arranged in the conveyer path C between the head 5 and the ejection tray 6.

The cut-sheet feeder roller 3*a* is supported by an arm 3*y* at a tip end of the arm 3*y*. The arm 3*y* is pivotably supported by a pivot shaft 3*x*. Under the control of the controller 10, an arm-driving motor (not shown) may be activated, and the arm 3*y* may pivot about the pivot shaft 3*x*. Thereby, the cut-sheet feeder roller 3*a* may be selectively located at one of a withdrawn position as shown in FIG. 1 and a feeding position as shown in FIG. 2. The cut-sheet feeder roller 3*a* is, when located at the feeding position as shown in FIG. 2, urged against a bottom surface of the feeder tray 1.

As shown in FIG. 1, when the rolled sheet R is stored in the rolled-sheet storage 11 and the cut-sheet feeder roller 3*a* is located at the withdrawn position, a feeder motor (not shown) may be activated under the control of the controller 10, and the rolled-sheet feeder rollers 14, 15 may rotate. Thereby, the rolled sheet R may rotate in a direction of an arrow B, and the sheet P unrolled from the rolled sheet R may be fed to the conveyer path C and conveyed in a direction toward the intermediate roller pair 3*b*, e.g., rearward.

Figure 2:
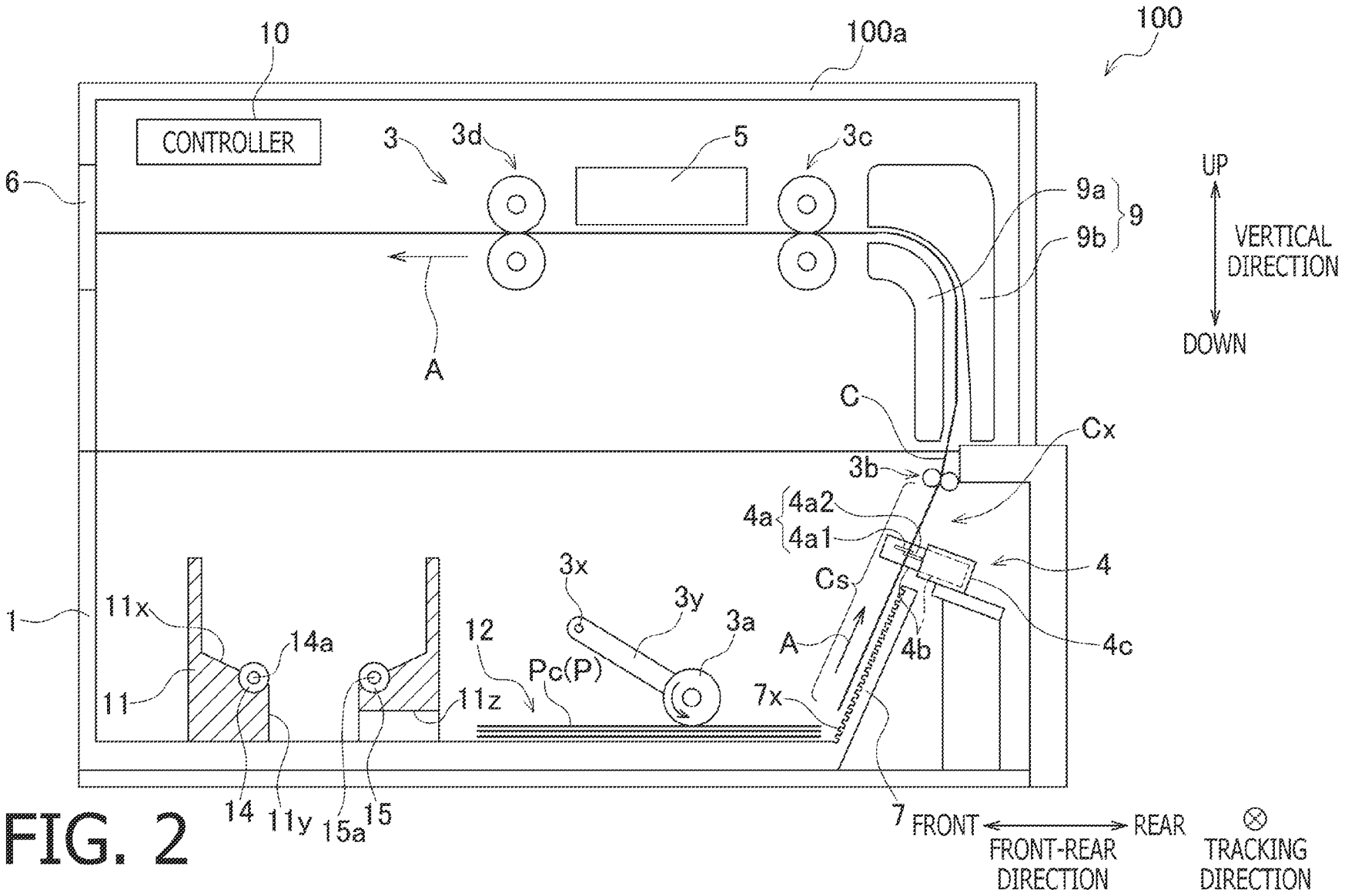
FIG. 2 is an overall illustrative view of the printer, with a rolled sheet removed and cut sheets stored therein, according to the first embodiment of the present disclosure.

As shown in FIG. 2, when the cut sheets Pc are stored in the cut-sheet storage 12 and the cut-sheet feeder roller 3*a* is located at the feeding position, the feeder motor (not shown) may be activated under the control of the controller 10, and the cut-sheet feeder roller 3*a* may rotate. Thereby, an uppermost one of the cut sheets Pc among the cut sheets Pc stored in the cut-sheet storage 12 may be conveyed toward the intermediate roller pair 3*b*, e.g., rearward, and fed to the intermediate roller pair 3*b*.

Each of the intermediate roller pair 3*b*, the conveyer roller pair 3*c*, and the ejection roller pair 3*d* has two (2) rollers, which may be rotated by driving of a conveyer motor (not shown). When the conveyer motor is activated under the control of the controller 10, the intermediate roller pair 3*b*, the conveyer roller pair 3*c*, and the ejection roller pair 3*d* being fed with the sheet P may nip the sheet P and rotate;

thereby the sheet P may be conveyed in the conveying direction along the conveyer path C.

The intermediate roller pair 3*b*, the conveyer roller pair 3*c*, and the ejection roller pair 3*d* are supported by the housing 100*a*. Meanwhile, the rolled-sheet feeder rollers 14, 15 and the cut-sheet feeder roller 3*a* are supported by the feeder tray 1.

The conveying direction A is arranged to be inverted at a position between the intermediate roller pair 3*b* and the conveyer roller pair 3*c*. In particular, in the present embodiment, between a part of the conveyer path C from the rolled-sheet and cut-sheet storages 11, 12 to the intermediate roller pair 3*b* and another part of the conveyer path C from the conveyer roller pair 3*c* to the ejection tray 6, frontward and rearward directional components in the conveying direction A are opposite.

The guide 7 is arranged between the cut-sheet feeder roller 3*a* and the intermediate roller pair 3*b* in the conveyer path C and may guide the sheet P fed by the rolled-sheet feeder rollers 14, 15 or the cut-sheet feeder roller 3*a* to the intermediate roller pair 3*b*. The guide 7 is formed of a rearward side wall of the feeder tray 1, which inclines to rise upper-rearward. A surface of the guide 7 that delimits a part of the conveyer path C is formed to have thin zigzags 7*x* repeating along the conveying direction A. With the zigzags 7*x* on the surface on the guide 7, overfeeding of the cut sheets Pc, i.e., an event that a plurality of cut sheets Pc are conveyed simultaneously in layers, may be restrained from occurring.

The guide 9 is arranged in the conveyer path C between the intermediate roller pair 3*b* and the conveyer roller pair 3*c* and may guide the sheet P passed from the intermediate roller pair 3*b* to the conveyer roller pair 3*c*. The guide 9 includes a pair of path members 9*a*, 9*b*, which are arranged on one side, e.g., on a front side, and the other side, e.g., a rear side, of the conveyer path C.

The cutter assembly 4 may cut the sheet P, more specifically, the sheet P unrolled from the rolled sheet R, at a predetermined position Cx in the conveyer path C between the guide 7 and the intermediate roller pair 3*b*. The cutter assembly 4 includes a cutter 4*a*, a cutter unit 4*b*, on which the cutter 4*a* is mounted, and a holder 4*c* to retain the cutter unit 4*b*. The cutter assembly 4 may be moved by a tracking assembly 2 to reciprocate in the tracking direction, which intersects orthogonally with the conveying direction A at the predetermined position Cx (see FIG. 3).

The conveyer path C includes a linear section Cs in an area between the cut-sheet feeder roller 3*a* and the intermediate roller pair 3*b*. The predetermined position Cx, at which the cutter assembly 4 is arranged, is located in the linear section Cs.

The cutter 4*a* includes a pair of rotary blades 4*a*1, 4*a*2, which are arranged across the conveyer path C. The rotary blades 4*a*1, 4*a*2 have parts that spread orthogonally to the conveyer path C and overlap each other. In particular, between the pair of rotary blades 4*a*1, 4*a*2, the rotary blade 4*a*1 is located downstream in the conveying direction A, and the rotary blade 4*a*2 is located upstream in the conveying direction; and the parts of the rotary blades 4*a*1, 4*a*2 spreading orthogonally to the conveyer path C overlap each other in the conveying direction A.

The cutter unit 4*b* supports the rotary blades 4*a*1, 4*a*2 rotatably. The holder 4*c* is a casing member to retain the cutter unit 4*b* from an outer side.

Figure 3:
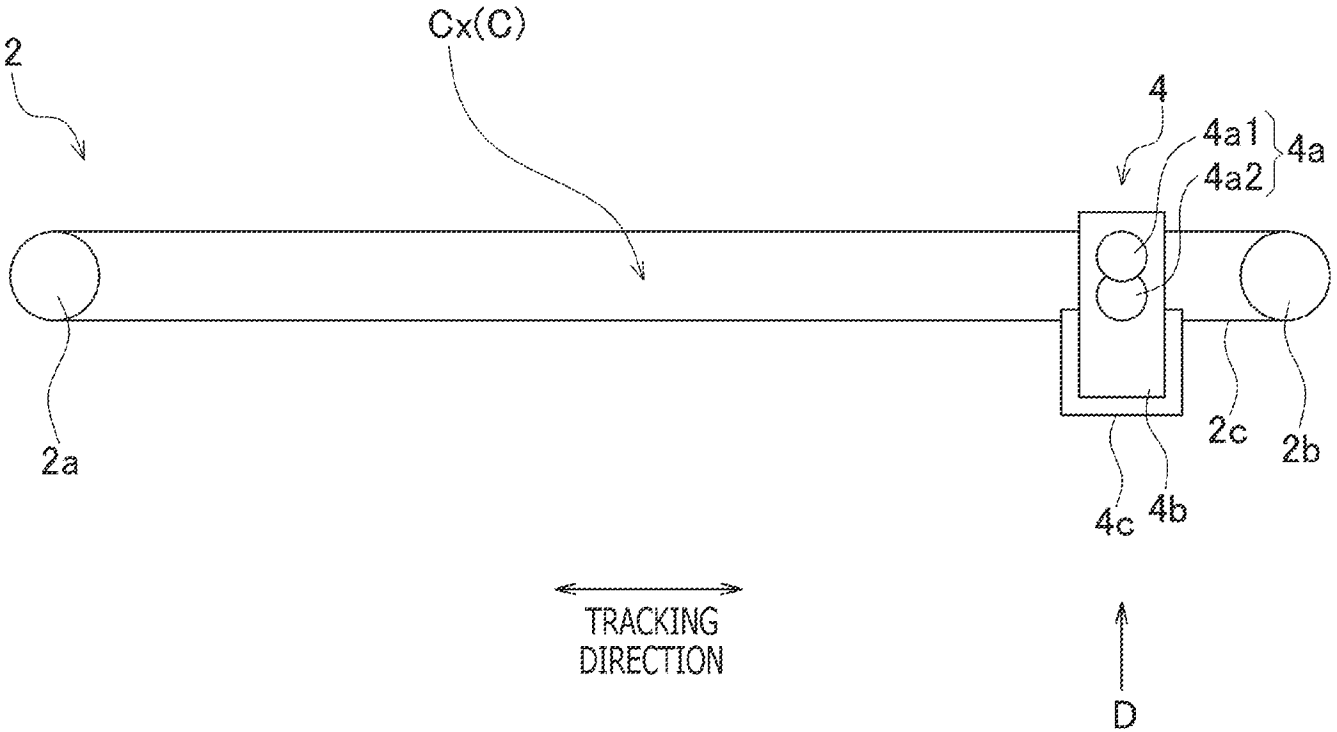
FIG. 3 is an illustrative view of a cutter assembly and a tracking assembly in the printer according to the first embodiment of the present disclosure.
Figure 4:
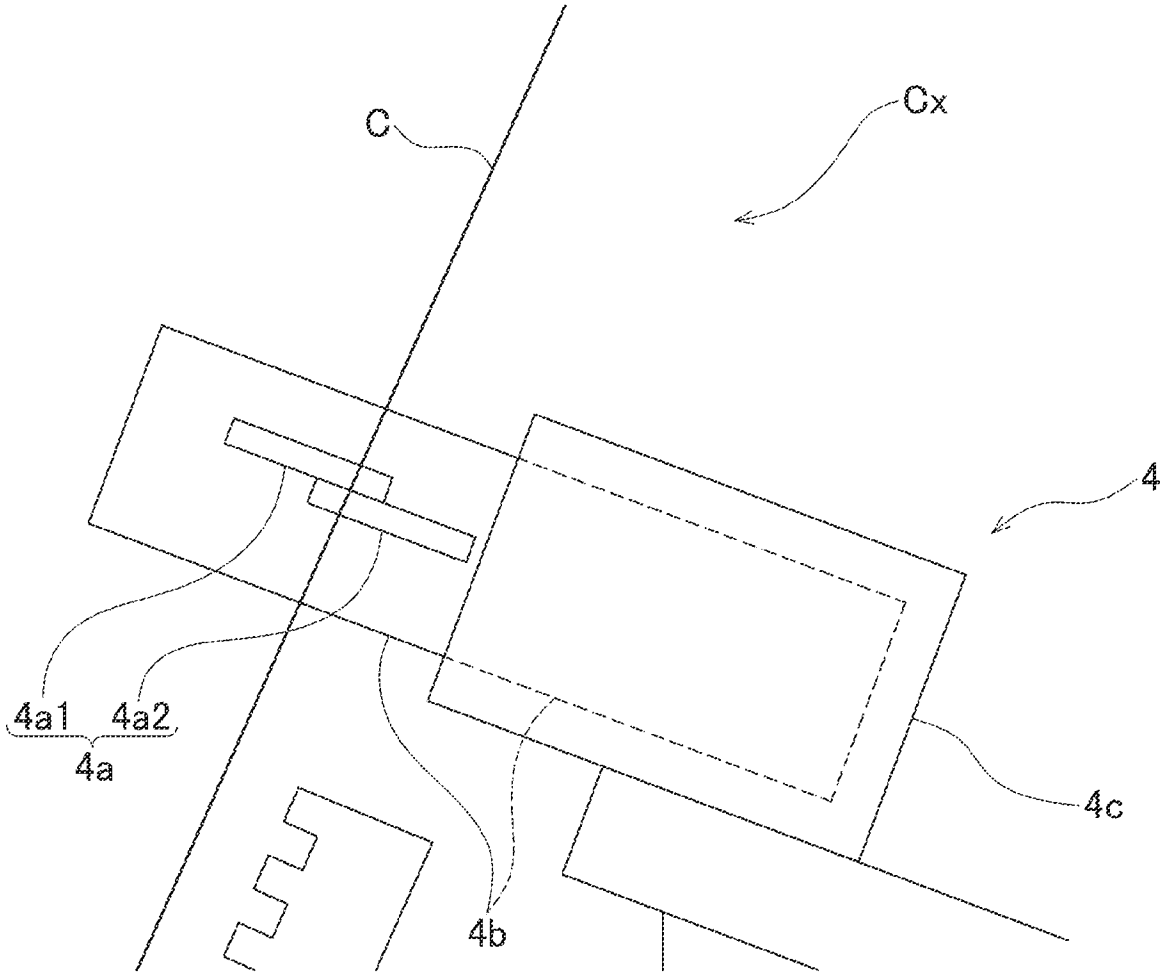
FIG. 4 is an enlarged view of an area IV shown in FIG. 1 in the printer according to the first embodiment of the present disclosure.

The tracking assembly 2 includes, as shown in FIG. 3, a pair of pulleys 2*a*, 2*b*, which are separated from each other in the tracking direction; a belt 2*c*, which is strained around the pulleys 2*a*, 2*b*, and onto which the holder 4*c* is fixed; and a cutter motor (not shown). When the cutter motor is activated under the control of the controller 10, the belt 2*c* may move in the tracking direction; and the holder 4*c* and the cutter unit 4*b* retained by the holder 4*c*, in other words, the entire cutter assembly 4 including the cutter 4*a*, may move from a standby position D, which is outside the conveyer path C, into the conveyer path C. Simultaneously, by driving of the cutter motor, the rotary blades 4*a*1, 4*a*2 may rotate. Thereby, the sheet P unrolled from the rolled sheet R may be cut with the cutter 4*a* at the predetermined position Cx along the widthwise direction of the sheet P.

The cutter assembly 4 and the tracking assembly 2 are supported by the housing 100*a*.

The head 5 is located in the conveyer path C between the conveyer roller pair 3*c* and the ejection roller pair 3*d*. The head 5 includes a plurality of nozzles (not shown) formed on a lower surface thereof and a driver IC. When the driver IC is activated under the control of the controller 10, ink may be discharged through the nozzles, and an image may be formed on the sheet P when the sheet P passes through a position to face the lower surface of the head 5. Optionally, the head 5 may either be a line-formation head, which may stay at a fixed position while discharging the ink through the nozzles, or a serial-formation head, which may move in the tracking direction while discharging the ink through the nozzles.

The sheet P with the image formed thereon by the head 5 may be caught in the ejection tray 6, which is open with respect to the housing 100*a*.

The controller 10 is connected with the feeder motor, the conveyer motor, the cutter motor, and the driver IC through internal busses (not shown). The controller 10 includes a central processing unit (CPU), a read-only memory (ROM), and a random-access memory (RAM). The ROM may store programs and data, which may be used by the CPU to control operations in the printer 100. The RAM may temporally store data to be used in the programs run by the CPU.

<Benefits>

According to the first embodiment described above, the cutter 4*a* may cut the sheet P at the predetermined position Cx, which is between the rolled-sheet feeder rollers 14, 15 or the cut-sheet feeder roller 3*a* and the intermediate roller pair 3*b*, in the conveyer path C (see FIGS. 1 and 2). In this arrangement, after the sheet P is cut by the cutter 4*a*, a part of the remaining sheet P having a loose end created by the cutter 4*a* cutting the sheet P, i.e., a part of the remaining sheet P on an upstream side with respect to the predetermined position Cx in the conveying direction A, is not nipped by the intermediate roller pair 3*b*. Therefore, the sheet P may be restrained from bearing a load that may be caused by a force to pull the feeder tray 1 outward from the housing 100*a*.

The feeder tray 1 has the rolled-sheet storage 11 (see FIG. 1). The sheet P unrolled from the rolled sheet R may be relatively long in the conveying direction A. Therefore, the sheet P may often be cut by the cutter 4*a*. Meanwhile, with the rolled sheet R being stored in the rolled-sheet storage 11, when the feeder tray 1 is pulled outward from the housing 100*a*, if the sheet P is nipped by the intermediate roller pair 3*b*, the sheet P may be subject to a load caused by relative displacement between a part of the sheet P stored in the rolled-sheet storage 11 and another part of the sheet P nipped by the intermediate roller pair 3*b*. In this regard, according to the present embodiment, in which the cutter 4*a* may cut the sheet P at the predetermined position Cx in the conveyer path C between the rolled-sheet feeder rollers 14, 15 and the intermediate roller pair 3*b*, the sheet P may be restrained from bearing the load that may be caused by the force to pull the feeder tray 1 outward from the housing 100*a*.

The feeder tray 1 has the cut-sheet storage 12 (see FIG. 2). The length of the cut sheet Pc in the conveying direction A stored in the cut-sheet storage 12 is greater than the distance between the cut-sheet feeder roller 3*a* and the intermediate roller pair 3*b* in the conveyer path C. In this regard, when the feeder tray 1 is pulled outward from the housing 100*a*, the cut sheet Pc may also be subject to the load at a part between a position, at which the cut sheet Pc is pressed by the cut-sheet feeder roller 3*a*, and the position, at which the cut sheet Pc is nipped by the intermediate roller pair 3*b*. However, according to the present embodiment, in which the cutter 4*a* may cut the sheet P at the predetermined position Cx in the conveyer path C between the cut-sheet feeder roller 3*a* and the intermediate roller pair 3*b*, the sheet P may be restrained from bearing the load that may be caused by the force to pull the feeder tray 1 outward from the housing 100*a*.

The feeder tray 1 has the rolled-sheet storage 11 and the cut-sheet storage 12, and the conveyer assembly 3 may convey the sheet P selectively from one of the rolled-sheet storage 11 and the cut-sheet storage 12 (see FIGS. 1 and 2). In this arrangement, the rolled sheet R and the cut sheets Pc may be selectively usable.

The rolled-sheet feeder rollers 14, 15 and the cut-sheet feeder roller 3*a* are supported by the feeder tray 1. In this arrangement, when the feeder tray 1 is pulled outward from the housing 100*a*, the sheet P may be subject to a load caused by relative displacement between a part of the sheet P supported by the rolled-sheet feeder rollers 14, 15 and another part of the sheet P nipped by the intermediate roller pair 3*b*. Meanwhile, concerning the cut sheet Pc, when the feeder tray 1 is pulled outward from the housing, the sheet P may be subject to a load caused by relative displacement between a part of the sheet P contacting the cut-sheet feeder roller 3*a* and another part of the sheet P nipped by the intermediate roller pair 3*b*. However, according to the present embodiment, in which the cutter 4*a* may cut the sheet P at the predetermined position Cx in the conveyer path C between the rolled-sheet feeder rollers 14, 15 or the cut-sheet feeder roller 3*a* and the intermediate roller pair 3*b*, the sheet P may be restrained from bearing the load that may be caused by the force to pull the feeder tray 1 outward from the housing 100*a*.

The feeder tray 1 may be pulled in the direction opposite to the direction, in which the rolled-sheet feeder rollers 14, 15 and the cut-sheet feeder roller 3*a* may convey the sheet P, to be drawn outward from the housing 100*a*. In this arrangement, if the sheet P is nipped by the intermediate roller pair 3*b* when the feeder tray 1 is pulled outward from the housing 100*a*, a pulling force may act on the sheet P, and the sheet P may be damaged. However, according to the present embodiment, in which the cutter 4*a* may cut the sheet P at the predetermined position Cx in the conveyer path C between the rolled-sheet feeder rollers 14, 15 or the cut-sheet feeder roller 3*a* and the intermediate roller pair 3*b*, the sheet P may be restrained from being damaged when the feeder tray 1 is pulled outward from the housing 100*a*.

The intermediate roller pair 3*b* has two (2) driving rollers, which may rotate by the driving force from the conveyer motor (not shown). In this regard, the nipping force of the intermediate roller pair 3*b* to nip the sheet P may be intense; therefore, if the feeder tray 1 is pulled outward from the housing 100*a* with the sheet P being nipped by the intermediate roller pair 3*b*, the sheet P may be subject to the intense force and may be damaged easily. In this regard, according to the present embodiment, in which the cutter 4*a* may cut the sheet P at the predetermined position Cx in the conveyer path C between the rolled-sheet feeder rollers 14, 15 or the cut-sheet feeder roller 3*a* and the intermediate roller pair 3*b*, the sheet P may be restrained from being damaged when the feeder tray 1 is pulled outward from the housing 100*a*.

Second Embodiment

A second embodiment of the present disclosure will be described below. In the second embodiment, a conveyer assembly 3' in a printer 100' may not convey the sheet P selectively from one of the rolled-sheet storage 11 and the cut-sheet storage 12. In other words, the printer 100' may not have the cut-sheet storage 12 but may have the rolled-sheet storage 11 alone, and the conveyer assembly 3' may convey the sheet P from the rolled-sheet storage 11 alone. In the second embodiment, parts or items that are substantially same or similar to those described earlier in the first embodiment may be denoted by the same reference sings, and description of those may be omitted.

The printer 100' has a feeder tray 1', which includes the rolled-sheet storage 11, in which a rolled sheet R (see FIG. 5) may be stored.

The conveyer assembly 3' in the second embodiment does not have the cut-sheet feeder roller 3*a* but has a feeder roller 3*a'*. Moreover, the conveyer assembly 3' includes an intermediate roller pair 3*b'*, a conveyer roller pair 3*c'*, an ejection roller pair 3*d'*, and guides 7', 9. The sheet P may be conveyed by the conveyer assembly 3' from the rolled-sheet storage 11 along the conveyer path C in the conveying direction A through the area below the head 5 toward the ejection tray 6.

The feeder roller 3*a'* is located in the conveyer path C between the rolled-sheet storage 11 and the head 5. The intermediate roller pair 3*b'* is arranged in the conveyer path C between the feeder roller 3*a'* and the head 5. The conveyer roller pair 3*c'* is arranged in the conveyer path C between the intermediate roller pair 3*b'* and the head 5. The ejection roller pair 3*d'* is arranged in the conveyer path C between the head 5 and the ejection tray 6.

Figure 5:
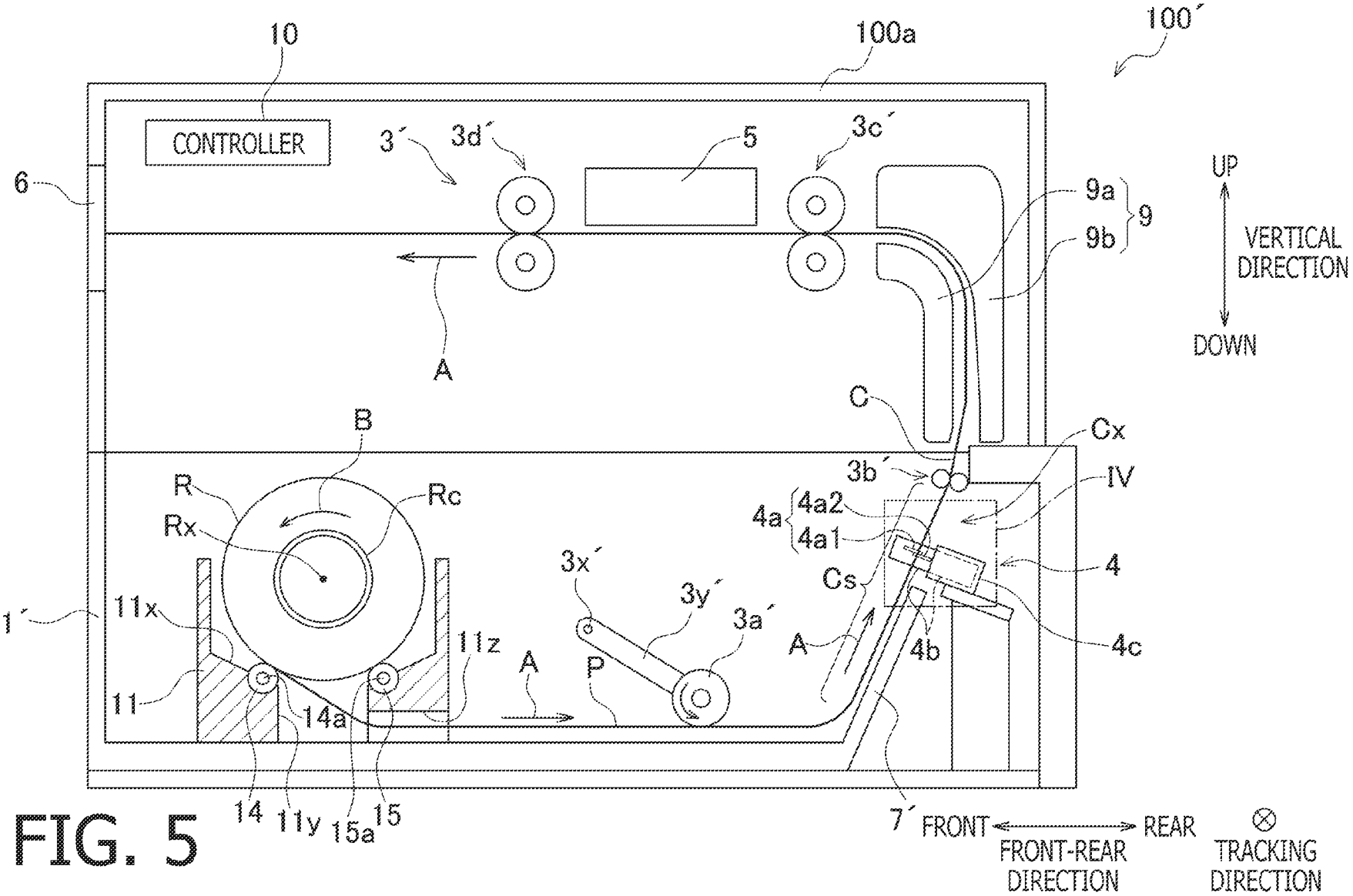
FIG. 5 is an overall illustrative view of a printer according to a second embodiment of the present disclosure.

The feeder roller 3*a'* is supported by an arm 3*y'* at a tip end of the arm 3*y'*. The arm 3*y'* is pivotably supported by a pivot shaft 3*x'* and is urged in an arrangement such that the feeder roller 3*a'* tends to be closer to a bottom surface of the feeder tray 1'. As shown in FIG. 5, when the rolled sheet R is stored in the rolled-sheet storage 11, a feeder motor (not shown) may be activated under the control of the controller 10, and the feeder roller 3*a'* may rotate. Thereby, the rolled sheet R may rotate in the direction of the arrow B, and the sheet P unrolled from the rolled sheet R may be conveyed in the direction toward the intermediate roller pair 3*b'*.

Each of the intermediate roller pair 3*b'*, the conveyer roller pair 3*c'*, and the ejection roller pair 3*d'* has two (2) rollers, one of which is a driving roller rotated by a conveyer motor (not shown) being activated, and the other of which is a driven roller being rotated by the rotation of the paired driving roller. When the conveyer motor is activated under the control of the controller 10, the intermediate roller pair 3*b'*, the conveyer roller pair 3*c'*, and the ejection roller pair 3*d'* being fed with the sheet P may nip the sheet P and rotate; thereby the sheet P may be conveyed in the conveying direction along the conveyer path C.

The conveying direction A is arranged to be inverted at a position between the intermediate roller pair 3*b'* and the conveyer roller pair 3*c*'. In particular, in the present embodiment, between a part of the conveyer path C from the rolled-sheet storage 11 to the intermediate roller pair 3*b*' and another part of the conveyer path C from the conveyer roller pair 3*c*' to the ejection tray 6, frontward and rearward directional components in the conveying direction A are opposite.

The guide 7' is arranged in the conveyer path C between the feeder roller 3*a*' and the intermediate roller pair 3*b*' and may guide the sheet P fed by the feeder roller 3*a*' to the intermediate roller pair 3*b*'. The guide 7' is formed of a rearward side wall of the feeder tray 1', which inclines to rise upper-rearward. Unlike the surface of the guide 7 in the first embodiment, a surface of the guide 7' may be a plain surface without zigzags.

The conveyer path C includes the linear section Cs in a range between the feeder roller 3*a*' and the intermediate roller pair 3*b*'. The predetermined position Cx, at which the cutter assembly 4 is arranged, is located in the linear section Cs.

<Benefits>

According to the second embodiment described above, the cutter 4*a* may cut the sheet P at the predetermined position Cx, which is between the feeder roller 3*a*' and the intermediate roller pair 3*b*', in the conveyer path C (see FIG. 5). In this arrangement, a distance between the rolled-sheet storage 11 and the predetermined position Cx may be relatively short compared to, for example, a printer, in which a cutter may cut a sheet at a position downstream from the head 5 in the conveying direction A. Therefore, an amount of the sheet P to be rewound may be reduced, and a time required for an action to rewind the sheet P may be shortened.

The printer 100' includes the feeder tray 1', which has the rolled-sheet storage 11, and the housing 100*a*, to which the feeder tray 1' may be detachably attached (see FIG. 5). In this arrangement, the time required for the action to rewind the sheet P, in order to avoid the loose end of the sheet P from being deformed by colliding with the housing 100*a* when the feeder tray 1' is detached from or attached to the housing 100*a*, may be shortened. Therefore, a waiting time for a user to wait for the rewinding action to end before attaching or detaching the feeder tray 1' to or from the housing 100*a* may be shortened.

In the printer 100' according to the second embodiment, the conveying direction A is inverted in a range between the intermediate roller pair 3*b*' and the conveyer roller pair 3*c*' (see FIG. 5). In the range in the conveyer path C between the feeder roller 3*a*' and the intermediate roller pair 3*b*', where the conveying direction A is not yet inverted, the load to act on the sheet P being conveyed in this range may be relatively small. In this regard, the sheet P may be cut at the predetermined position Cx in this range accurately and reliably.

The conveyer path C includes the linear section Cs in the range between the feeder roller 3*a*' and the intermediate roller pair 3*b*'. The predetermined position Cx is arranged in the linear section Cs (see FIG. 5). In the linear section Cs, the load to act on the sheet P being conveyed in this range may be smaller compared to the load to act on the sheet P being in a curved section. In this regard, the sheet P may be cut at the predetermined position Cx in this range where the load is smaller accurately and reliably.

The cutter 4*a* includes the rotary blades 4*a*1, 4*a*2, which are arranged to intersect with the conveyer path C (see FIG. 3). In this arrangement, the sheet P may be cut accurately and reliably.

The cutter 4*a* is arranged at the predetermined position Cx, and a driving mechanism to drive the cutter 4*a*, e.g., the tracking assembly 2, may be arranged in the area around the predetermined position Cx, where the conveying direction A is not yet inverted. In this regard, a volume of the printer 100' having the cutter 4*a* and the driving mechanism in the area around the predetermined position Cx may not necessarily be forced to increase significantly. For example, the cutter 4*a* may be arranged at a position in the vicinity of the head 5, which is a downstream position in the conveying direction A with respect to the range where the conveying direction A is inverted. In this arrangement, however, a number of parts and devices (not shown in FIG. 5) may be arranged in the area around the head 5. Therefore, a room for arranging the cutter 4*a* and the driving mechanism may need be created, and the volume of the printer 100' may be forced to increase. In contrast, according to the second embodiment, and to the first embodiment, in which the cutter 4*a* is located at the predetermined position Cx, which is an upstream position in the conveying direction A with respect to the range where the conveying direction A is inverted, the volume of the printer 100' may be restrained from increasing.

MORE EXAMPLES

Although examples of carrying out the invention have been described, those skilled in the art will appreciate that there are numerous variations and permutations of the image forming apparatus that fall within the spirit and the scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiments may merely be regarded as examples of the claimed subject matters.

For example, the cutter may not necessarily consist of a pair of rotary blades but may consist of, for example, a single rotary blade or a single stationary blade.

For another example, the conveyer assembly may not necessarily be configured to convey the sheet unrolled from the rolled-sheet storage but may be configured to convey cut sheets from the cut-sheet storage alone.

For another example, the feeder rollers, e.g., the rolled-sheet feed roller and the cut-sheet feeder roller in the first embodiment and the feeder roller in the second embodiment, may not necessarily be supported by the feeder tray but may be supported by the housing.

For another example, in the first embodiment, the intermediate roller pair may not necessarily consist of two driving rollers but may consist of a driving roller and a driven roller.

For another example, the feeder tray may be detachable from the housing by being pulled in a direction intersecting orthogonally with the cross-sections shown in FIGS. 1, 2, and 5.

For another example, in the first embodiment, the guide located in the conveyer path between the cut-sheet feeder roller and the predetermined position may not necessarily have the zigzagged edges on the surface thereof that delimits the conveyer path, similarly to the guide in the second embodiment. For another example, in the first and second embodiments, the guide may not necessarily be provided at the position between the cut-sheet feeder roller or the feeder roller and the predetermined position in the conveyer path.

For another example, the conveying direction may not necessarily be inverted in the range between the intermediate roller pair and the conveyer roller pair in the frontward and rearward directional components but may be inverted in upward and downward directional components. In other words, the conveying direction may be inverted to orient in vertically opposite directions.

Moreover, the conveying direction may not necessarily be inverted in the range between the intermediate roller pair and the conveyer roller pair or any other range in the conveyer path.

For another example, the cutter may not necessarily be arranged in the linear section in the conveyer path but may be arranged in a curved section in the conveyer path.

For another example, concerning the second embodiment, in which the cut-sheet storage is not provided, the rolled-sheet storage may not necessarily be arranged on the feeder tray that is detachably attachable to the housing but may be arranged on the housing. Even with the rolled-sheet storage arranged on the housing, a loose end of an unrolled sheet-formed medium after being cut with a cutter may still be rewound into the rolled-sheet storage. In this regard, the present disclosure may still be effectively applied to reduce an amount of the sheet-formed medium to be rewound and shorten time required to the rewinding action.

For another example, a material of the sheet-formed medium may not necessarily be limited paper but may be, for example, cloth or resin.

For another example, the image forming apparatus may form images by discharging liquid other than ink such as, for example, a processing solution that may coagulate or precipitate components in the ink. For another example, the image forming style in the image forming device may not necessarily be limited to the liquid-discharging style but may be, for example, a laser irradiating style or a thermal-transfer style.

For another example, the image forming apparatus may not necessarily be limited to the printers as described above but may be a facsimile machine, a copier, and a multifunction peripheral machine.

What is claimed is:

1. An image forming apparatus, comprising:

a housing;

a tray detachably attachable to the housing, the tray having a storage configured to store a sheet-formed medium;

an image forming device configured to form an image on the sheet-formed medium;

a conveyer assembly configured to convey the sheet-formed medium from the storage along a conveyer path; and a cutter configured to cut the sheet-formed medium at a predetermined position in the conveyer path, wherein the conveyer assembly includes:

a feeder roller configured to feed the sheet-formed medium downward from the storage to the conveyer path along a bottom surface of the tray; and an intermediate roller pair arranged in the conveyer path between the feeder roller and the image forming device, wherein the intermediate roller pair is supported by the housing and is configured to nip the sheet-formed medium, and wherein the predetermined position is located in the conveyer path between the feeder roller and the intermediate roller pair.

2. The image forming apparatus according to claim 1, wherein the storage is configured to store a rolled body, the rolled body being the sheet-formed medium wound into a roll.

3. The image forming apparatus according to claim 1, wherein the storage is configured to store a plurality of sheet-formed media in a stack, a length of each of the plurality of sheet-formed media being greater than a distance between the feeder roller and the intermediate roller pair in the conveyer path.

4. The image forming apparatus according to claim 1, wherein the storage includes:

a first storage configured to store a rolled body, the rolled body being the sheet-formed medium wound into a roll; and a second storage configured to store a plurality of sheet-formed media in a stack, a length of each of the plurality of sheet-formed media being greater than a distance between the feeder roller and the intermediate roller pair in the conveyer path, wherein the conveyer assembly is configured to convey the sheet-formed medium selectively from one of the first storage and the second storage.

5. The image forming apparatus according to claim 1, wherein the feeder roller is supported by the tray.

6. The image forming apparatus according to claim 1, wherein the tray is movable to be drawn outward from the housing in a direction opposite to a direction of conveying the sheet-formed medium by the feeder roller.

7. The image forming apparatus according to claim 1, wherein the intermediate roller pair includes two driving rollers, each of which is-being rotatable by driving of a motor.

8. An image forming apparatus, comprising:

a storage configured to store a sheet-formed medium;

an image forming device configured to form an image on the sheet-formed medium;

a conveyer assembly configured to convey the sheet-formed medium from the storage in a conveying direction along a conveyer path; and a cutter configured to cut the sheet-formed medium at a predetermined position in the conveyer path, wherein the storage is configured to store a rolled body, the rolled body being the sheet-formed medium wound into a roll, wherein the conveyer assembly includes:

a feeder roller urged to be closer to a bottom surface of the storage, the feed roller being configured to feed the sheet-formed medium from the storage to the conveyer path;

an intermediate roller arranged in the conveyer path between the feeder roller and the image forming device; and a conveyer roller arranged in the conveyer path between the intermediate roller and the image forming device, wherein the predetermined position is located in the conveyer path between the feeder roller and the intermediate roller, and wherein the sheet-formed medium is unrolled downward from the roll and is urged downward against the bottom surface of the storage by the feeder roller to be conveyed along the bottom surface of the storage.

9. The image forming apparatus according to claim 8, further comprising:

a tray including the storage; and a housing, to which the tray is detachably attachable.

10. The image forming apparatus according to claim 8, wherein the conveying direction is arranged to invert between the intermediate roller and the conveyer roller.

11. The image forming apparatus according to claim 8, wherein the conveyer path includes a linear section between the feeder roller and the intermediate roller, and wherein the predetermined position is arranged in the linear section.

12. The image forming apparatus according to claim 8, wherein the cutter includes a blade, the blade being arranged to intersect orthogonally with the conveyer path.

* * * * *